US011123985B2

(12) United States Patent
Mizuno et al.

(10) Patent No.: US 11,123,985 B2
(45) Date of Patent: Sep. 21, 2021

(54) LIQUID EJECTION HEAD

(71) Applicant: Brother Kogyo Kabushiki Kaisha, Nagoya (JP)

(72) Inventors: Taisuke Mizuno, Yokkaichi (JP); Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/835,629

(22) Filed: Mar. 31, 2020

(65) Prior Publication Data

US 2020/0316942 A1 Oct. 8, 2020

(30) Foreign Application Priority Data

Apr. 4, 2019 (JP) ..... JP2019-072138

(51) Int. Cl.
*B41J 2/14* (2006.01)

(52) U.S. Cl.
CPC ..... *B41J 2/14145* (2013.01); *B41J 2/14032* (2013.01); *B41J 2/1433* (2013.01)

(58) Field of Classification Search
CPC .. B41J 2/14145; B41J 2/14032; B41J 2/1433; B41J 2/14233; B41J 2002/14419; B41J 2202/12; B41J 2002/14241; B41J 2/04501
USPC ..... 347/20, 54, 68, 84, 85
See application file for complete search history.

(56) References Cited

U.S. PATENT DOCUMENTS

| | | | | |
|---|---|---|---|---|
| 7,971,981 | B2 | 7/2011 | Nagashima et al. | |
| 8,870,353 | B2 * | 10/2014 | Watanabe | B41J 2/14274 347/70 |
| 10,022,967 | B2 * | 7/2018 | Mizuno | B41J 2/04505 |
| 10,549,539 | B2 * | 2/2020 | Katayama | B41J 2/14209 |
| 2008/0238980 | A1 | 10/2008 | Nagashima et al. | |
| 2012/0176450 | A1 | 7/2012 | Akahane et al. | |

FOREIGN PATENT DOCUMENTS

| | | | |
|---|---|---|---|
| JP | 2009-241316 | A | 10/2009 |
| JP | 4855992 | B2 | 1/2012 |
| JP | 2015-134507 | A | 7/2015 |
| JP | 6067521 | B2 | 1/2017 |

* cited by examiner

*Primary Examiner* — An H Do
(74) *Attorney, Agent, or Firm* — Banner & Witcoff, Ltd.

(57) ABSTRACT

A liquid ejection head includes a plurality of first individual channels arranged in a first direction, a first common channel extending in the first direction and communicating with the first individual channels, and a second common channel located below the first common channel and extending in the first direction. The second common channel communicates with the first individual channels. Each of the first individual channels includes one of first nozzles, and one of first pressure chambers that communicate with the respective first nozzles and are located above the first nozzles. The first common channel and the second common channel overlap, in the vertical direction, with each other at a position above the first pressure chambers. Each of the first common channel and the second common channel at least partially overlaps, in the vertical direction, with the first pressure chambers.

20 Claims, 8 Drawing Sheets

LIQUID EJECTION HEAD

CROSS-REFERENCE TO RELATED APPLICATION

This application claims priority from Japanese Patent Application No. 2019-072138 filed on Apr. 4, 2019, the content of which is incorporated herein by reference in its entirety.

TECHNICAL FIELD

Aspects of the disclosure relate to a liquid ejection head including a plurality of individual channels, a first common channel, and a second common channel.

BACKGROUND

A known liquid ejection head includes a plurality of individual channels arranged in a longitudinal direction of the head (e.g., a first direction). The liquid ejection head further includes common channels, e.g., a manifold and a circulation channel, that communicate with the respective individual channels. Each of the individual channels includes a nozzle and a pressure-generating chamber (pressure chamber) located above the nozzle.

SUMMARY

In the known liquid ejection head, the manifold, an array of the pressure-generating chambers (pressure chambers), and the circulation channel are arranged in a width direction of the head (e.g., a second direction). In this configuration, if volumes of the common channels are increased for the purpose of, for example, reducing pressure losses, the liquid ejection head may increase its size in the second direction.

Aspects of the disclosure provide a liquid ejection head that may increase volumes of common channels while preventing or reducing an increase in size of the liquid ejection head in a second direction.

According to one or more aspects of the disclosure, a liquid ejection head comprises a plurality of first individual channels, a first common channel, and a second common channel. The first individual channels are arranged in a first direction perpendicular to a vertical direction. The first common channel extends in the first direction. The first common channel communicates with the first individual channels. The second common channel is located below the first common channel and extends in the first direction. The second common channel communicates with the first individual channels. Each of the first individual channels includes one of first nozzles, and one of first pressure chambers that communicate with the respective first nozzles and are located above the first nozzles. The first common channel and the second common channel overlap, in the vertical direction, with each other at a position above the first pressure chambers. Each of the first common channel and the second common channel at least partially overlaps, in the vertical direction, with the first pressure chambers.

According to aspects of the disclosure, the liquid ejection head may increase volumes of the common channels while preventing or reducing an increase in size of the liquid ejection head in the second direction.

DETAILED DESCRIPTION

First Illustrative Embodiment

Figure 1:
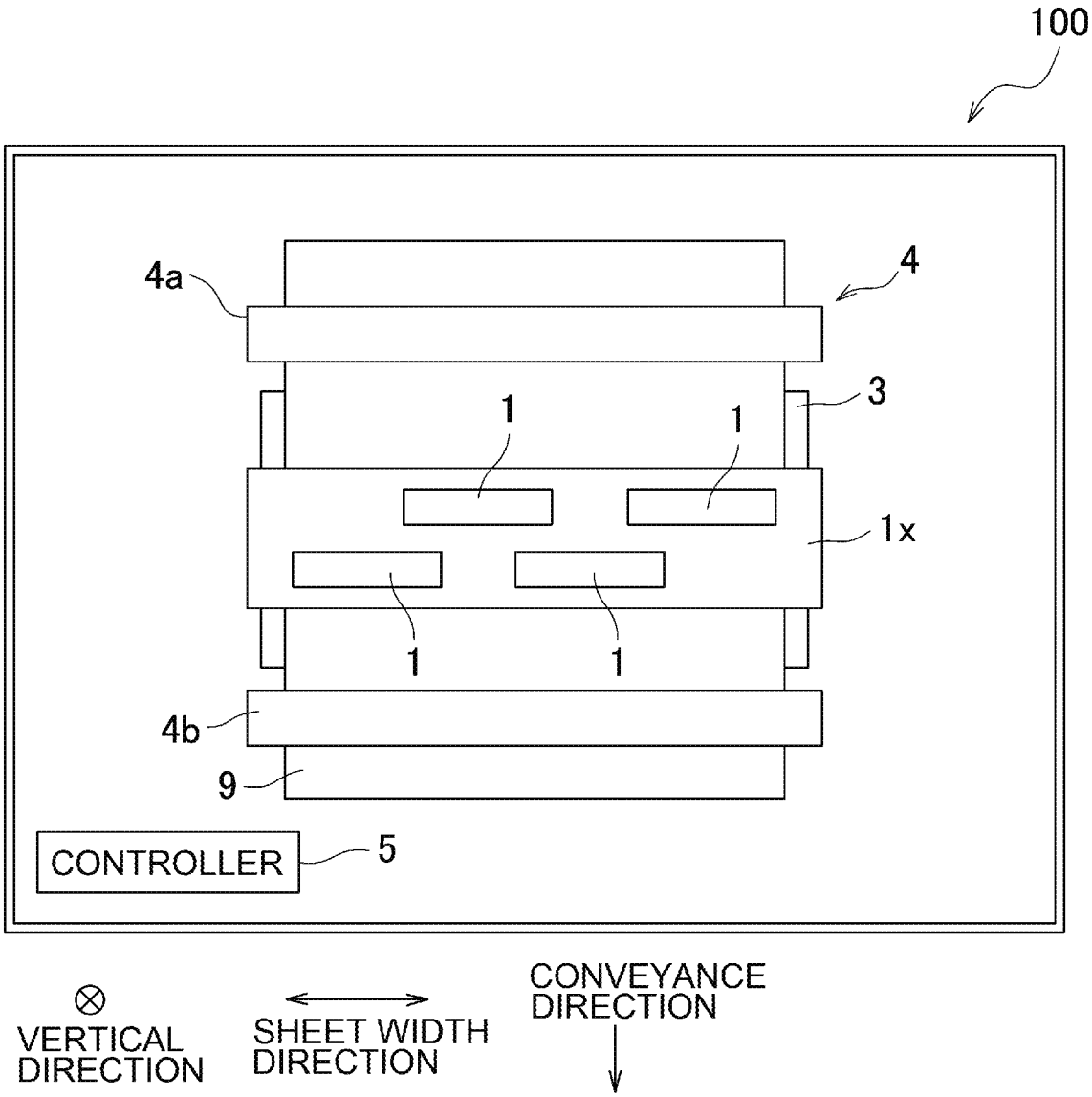
FIG. 1 is a plan view of a printer including a head in a first illustrative embodiment according to aspects of the disclosure.

Referring to FIG. 1, a configuration of a printer 100 including a head 1 according to a first illustrative embodiment of the disclosure will be described below.

The printer 100 includes a head unit 1*x* that includes four heads 1, a platen 3, a conveyance mechanism 4, and a controller 5.

The platen 3 has an upper surface configured to support a sheet 9.

Figure 4:
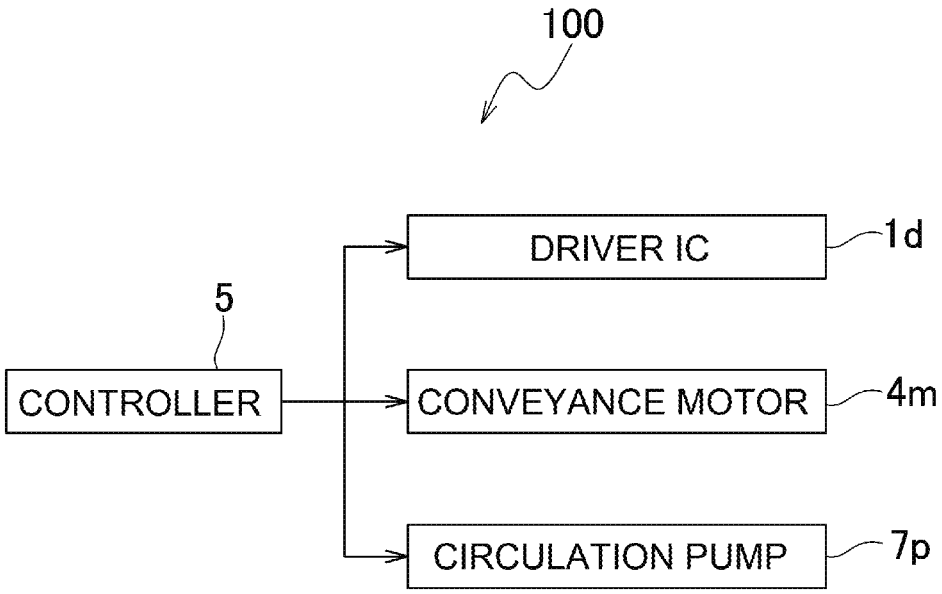
FIG. 4 is a block diagram illustrating an electrical configuration of the printer of FIG. 1.

The conveyance mechanism 4 has two roller pairs 4*a* and 4*b* sandwiching the platen 3 in a conveyance direction. A conveyance motor 4*m* (refer to FIG. 4) is driven under the control of the controller 5. This may cause the roller pairs 4*a* and 4*b* to rotate while pinching the sheet 9, thereby conveying the sheet 9 in the conveyance direction.

The head unit 1*x* is longer in a sheet width direction, which is perpendicular to both of the conveyance direction and a vertical direction. The head unit 1*x* is of a line type, in which the head unit 1*x* at a fixed position ejects ink to the sheet 9 through nozzles 11 (refer to FIGS. 2 and 3). Each of the four heads 1 is longer in the sheet width direction. The four heads 1 are staggered in the sheet width direction.

The controller 5 includes a read only memory (ROM), a random access memory (RAM), and an application specific integrated circuit (ASIC). The ASIC performs processes, such as a recording process, in accordance with programs stored in the ROM. In the recording process, the controller 5 controls a driver IC 1*d* (refer to FIG. 4) in each head 1 and the conveyance motor 4*m* (refer to FIG. 4) in accordance with a recording command (including image data) input from an external device, such as a personal computer (PC), to record an image on the sheet 9.

Figure 2:
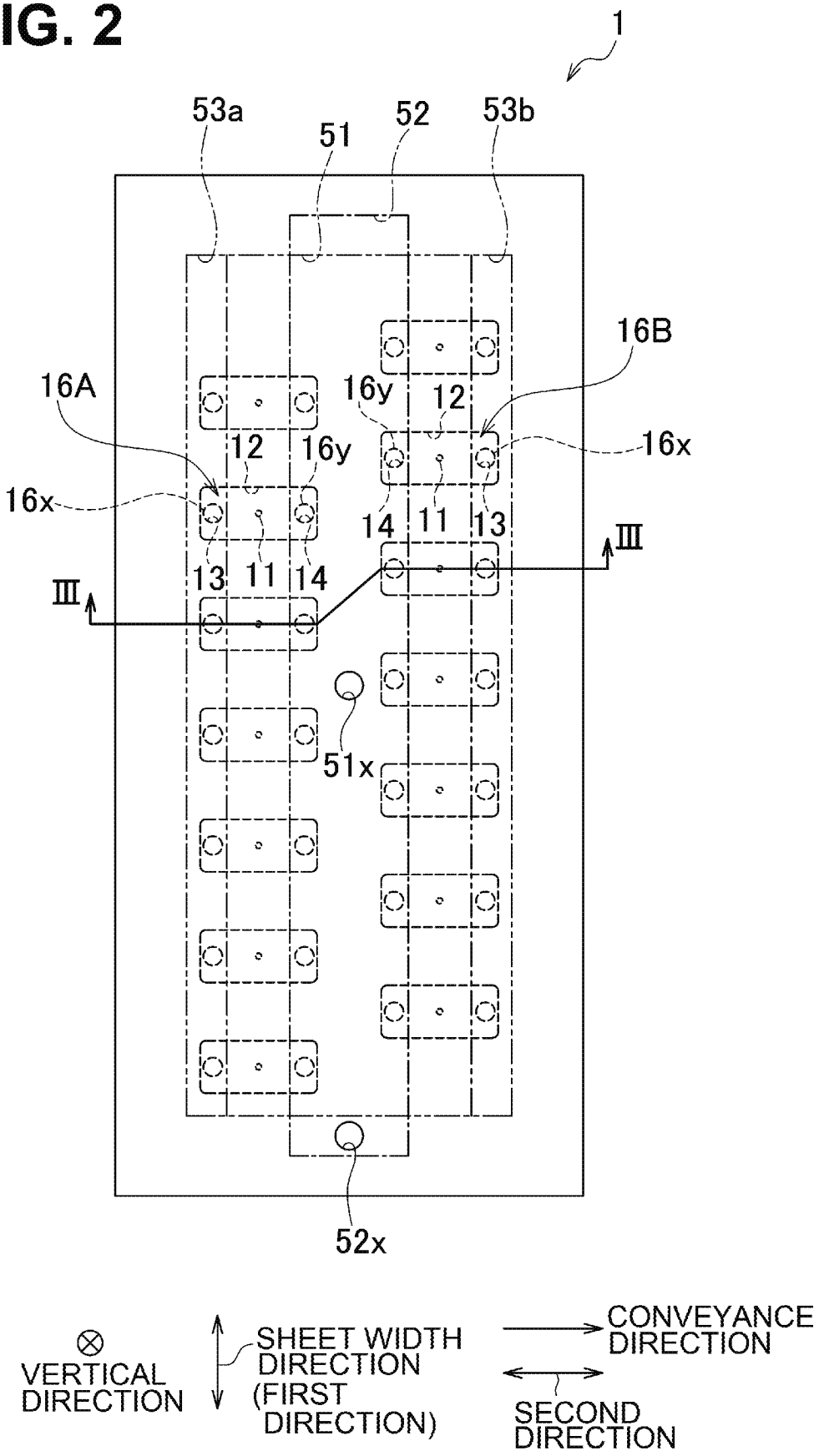
FIG. 2 is a plan view of the head of the printer of FIG. 1.
Figure 3:
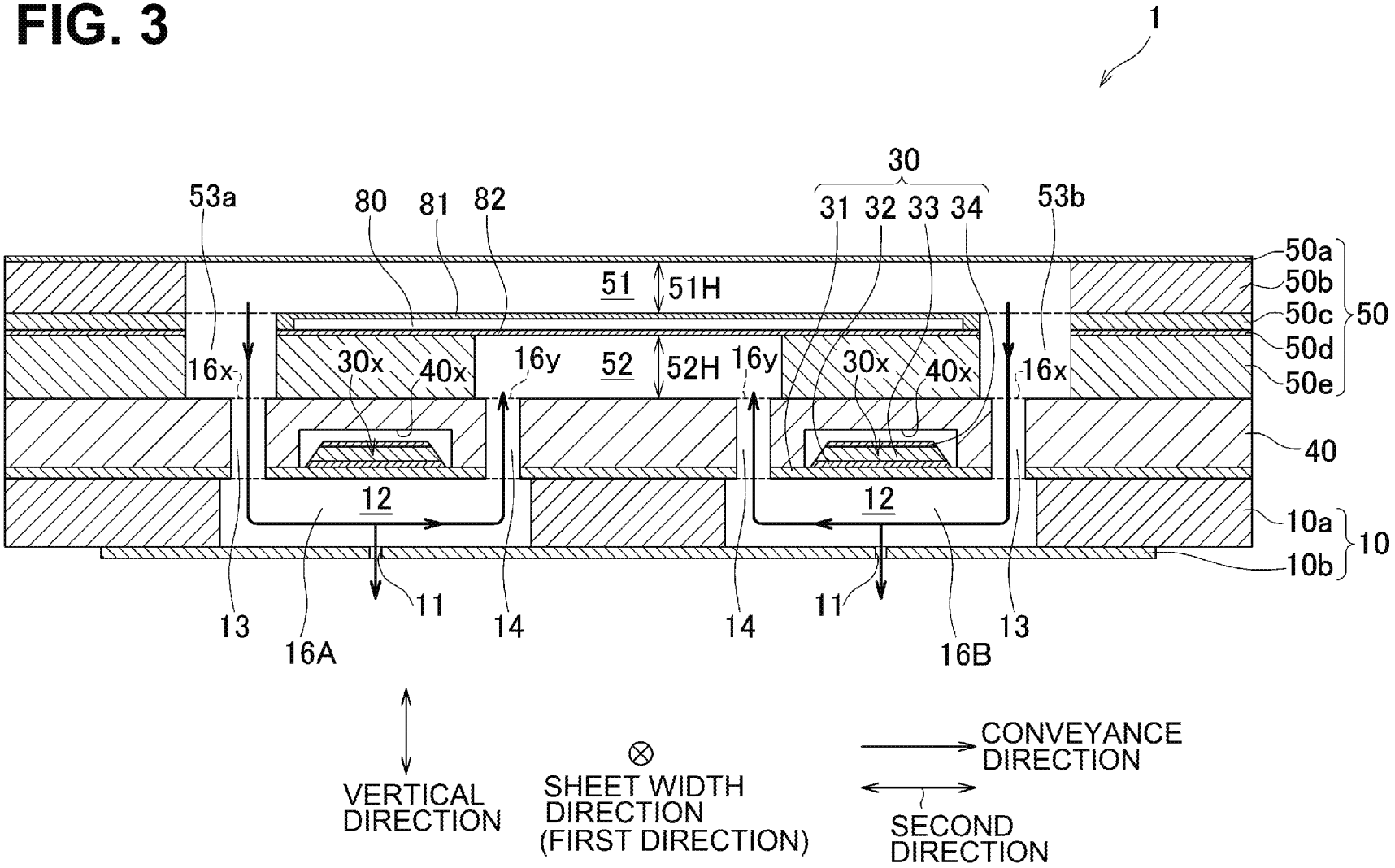
FIG. 3 is a cross-sectional view of the head, taken along a line in FIG. 2.

Referring to FIGS. 2 and 3, a configuration of the head 1 will now be described.

As depicted in FIG. 3, the head 1 includes a channel substrate 10, an actuator substrate 30, a protection substrate 40, and a casing 50.

The channel substrate 10 is disposed below the casing 50. The channel substrate 10 includes two plates 10*a* and 10*b*, which are laminated in the vertical direction. The plate 10*a* (e.g., a pressure chamber substrate as claimed) has pressure chambers 12 formed therein. The plate 10*b* (e.g., a nozzle plate as claimed) has nozzles 11 formed therein.

Each of the nozzles 11 is provided in correspondence with a respective one of the pressure chambers 12. The nozzle 11 is disposed below the corresponding pressure chamber 12 and communicates with the pressure chamber 12. In the illustrative embodiment, the nozzle 11 is located directly below or under the pressure chamber 12 and no other channel or path is provided between the nozzle 11 and the pressure chamber 12 (unlike a second illustrative embodiment in which a connecting channel 215 is provided between the nozzle 11 and the pressure chamber 12).

As depicted in FIG. 2, the pressure chambers 12 are staggered in a longitudinal direction of the head 1. The longitudinal direction of the head 1 corresponds to a sheet width direction and is an example of a first direction as claimed. The pressure chamber 12 has a generally rectangular shape elongated in a width direction of the head 1 in a plane perpendicular to the vertical direction. The width direction of the head 1 is parallel to the conveyance direction and an example of a second direction as claimed. The nozzle is located at a central portion of the pressure chamber 12 in a plane perpendicular to the vertical direction.

The head 1 further includes a first communication channel 13 and a second communication channel 14 that communicate with respective end portions of the pressure chamber 12 in the second direction. As depicted in FIG. 3, the first communication channel 13 and the second communication channel 14 extend upward from the pressure chamber 12.

The nozzles 11, the pressure chambers 12, the first communication channels 13, and the second communication channels 14 constitute individual channels 16A and 16B. Each of the individual channels 16A and 16B has one nozzle 11, one pressure chamber 12, one first communication channel 13, and one second communication channel 14. An upper end of the first communication channel 13 corresponds to an inlet 16*x* of the individual channel 16A, 16B. An upper end of the second communication channel 14 corresponds to an outlet 16*y* of the individual channel 16A, 16B.

As depicted in FIG. 2, the first individual channels 16A are equi-distantly arranged in a row along the first direction. The second individual channels 16B are arranged adjacent to the first individual channels 16A in the second direction, and are equi-distantly arranged in a row along the first direction.

The pressure chamber 12 of the first individual channel 16A is an example of a first pressure chamber as claimed. The pressure chamber 12 of the second individual channel 16B is an example of a second pressure chamber as claimed.

The nozzle 11 of the first individual channel 16A is an example of a first nozzle as claimed. The nozzle 11 of the second individual channel 16B is an example of a second nozzle as claimed.

An array of the first communication channels 13 of the individual channels 16A and an array of the first communication channels 13 of the individual channels 16B are located opposite to each other in the second direction with respect to arrays of the second communication channels 14 of the individual channels 16A and 16B. In other words, the array of the second communication channels 14 of the individual channels 16A and the array of the second communication channels 14 of the individual channels 16B are located between the array of the first communication channels 13 of the first individual channels 16A and the array of the first communication channels 13 of the second individual channels 16B, in the second direction.

As depicted in FIG. 3, the plate 10*b* is shorter than the plate 10*a* in the second direction. The plate 10*b* is bonded to a lower surface of the plate 10*a*, covering, from below, the pressure chambers 12.

The actuator substrate 30 includes a diaphragm 31, two common electrodes 32, piezoelectric bodies 33, and individual electrodes 34 that are arranged in this order from below. The actuator substrate 30 is disposed at an upper surface of the plate 10*a*.

The diaphragm 31 is bonded to an upper surface of the plate 10*a*, covering all pressure chambers 12 formed in the plate 10*a*. In other words, the diaphragm 31 is disposed at the upper surface of the plate 10*a*. The diaphragm 31 has through holes that constitute portions of the first communication channels 13 and the second communication channels 14.

The two common electrodes 32 are formed on an upper surface of the diaphragm 31. Each of the common electrodes 32 is provided for a respective one of arrays of the individual channels 16A and 16B. The common electrode 32 extends in the first direction across the pressure chambers 12. Each common electrode 32 overlaps, in the vertical direction, with the pressure chambers 12 of the respective arrays of the individual channels 16A and 16B.

The piezoelectric body 33 and the individual electrode 34 are provided in correspondence with the pressure chamber 12, and overlap with the corresponding pressure chamber 12 in the vertical direction.

The driver IC 1*d* (refer to FIG. 4) is configured to electrically connect to the actuators 30*x*. The individual electrodes 34 and the common electrodes 32 electrically connect to the driver IC 1*d*. The driver IC 1*d* maintains the potential of the common electrodes 32 at a ground potential but changes the potential of the individual electrodes 34. In one example, the drive IC 1*d* generates drive signals based on control signals from the controller 5, and applies the drive signals to the individual electrodes 34, so that the potential of the individual electrodes 34 may change between a predetermined drive potential and the ground potential. This may cause an actuator 30*x*, which includes portions of the diaphragm 31 and the piezoelectric body 33 sandwiched between the individual electrode 34 and the pressure chamber 12, to deform convexly toward the pressure chamber 12, resulting in change in the volume of the pressure chamber 12. This may cause pressure application to ink in the pressure chamber 12, thereby ejecting the ink from the nozzle 11.

The protection substrate 40 is bonded to the upper surface of the diaphragm 31. In other words, the protection substrate 40 is disposed above the diaphragm 31 and at an upper surface of the diaphragm 31.

The protection substrate 40 has a lower surface having two recesses 40*x* extending in the first direction. One of the recesses 40*x* overlaps, in the vertical direction, with the pressure chambers 12 of the array of the first individual channels 16A. The other one of the two recesses 40*x* overlaps, in the vertical direction, with the pressure chambers 12 of the array of the second individual channels 16B. The actuators 30*x* corresponding to the respective individual channels 16A and 16B are located in the corresponding recesses 40*x* and overlap, in the vertical direction, with the respective pressure chambers 12.

The protection substrate 40 has through holes that constitute portions of the first communication channels 13 and the second communication channels 14.

The casing 50 is bonded on an upper surface of the protection substrate 40. The casing 50 includes five plates 50*a*-50*e* that are laminated in the vertical direction. The casing 50 has through holes formed in the plates 50*b*-50*e*. The through holes define a supply channel 51 (e.g., a first common channel as claimed), a return channel 52 (e.g., a second common channel as claimed), and vertical channels 53*a* and 53*b*. The return channel 52 has a lower surface defined by the protection substrate 40. The upper surface of the protection substrate 40 serves as the lower surface of the return channel 52.

The vertical channels 53*a* and 53*b* do not overlap with the recesses 40*x* in the vertical direction. If the vertical channels 53*a* and 53*b* should overlap with the recesses 40*x* in the vertical direction, the plate 50*e* and the protection substrate 40 might not be securely pressed against each other when bonded together, resulting in bonding failure. The configuration of the illustrative embodiment may prevent or reduce bonding failures.

The channels 51, 52, 53*a*, and 53*b* are disposed above the individual channels 16A and 16B. The channels 51, 52, 53*a*, and 53*b* at least partially overlap, in the vertical direction, with all of the pressure chambers 12 of the head 1. The return channel 52 and the vertical channels 53*a* and 53*b* are located below the supply channel 51 and overlap, in the vertical direction, with the supply channel 51. The supply channel 51 is longer in the second direction than the return channel 52 and protrudes to both sides of the return channel 52 in the second direction. The supply channel 51 has a dimension 51H in the vertical direction that is shorter than a dimension 52H of the return channel 52 in the vertical direction. The return channel 52 has a channel area that is perpendicular to the first direction. The channel area of the return channel 52 is smaller than that of the supply channel 51.

As depicted in FIG. 2, each of the supply channel 51 and the return channel 52 extends in the first direction. Each of the vertical channels 53*a* and 53*b* is located at a respective end of the supply channel 51 in the second direction, and extends in the first direction. In the first direction, the vertical channels 53*a* and 53*b* have the same length as the supply channel 51.

The supply channel 51 communicates with the inlets 16*x* of all of the individual channels 16A and 16B formed in the head 1, via the vertical channels 53*a* and 53*b*. The vertical channel 53*a* brings one end of the supply channel 51 in the second direction into communication with the inlets 16*x* of the first individual channels 16A. The vertical channel 53*b* brings the other end of the supply channel 51 in the second direction into communication with the inlets 16*x* of the second individual channels 16B. The inlets 16*x* are arranged in the first direction at lower end portions of the vertical channels 53*a* and 53*b*. The supply channel 51 communicates with the inlets 16*x* of the first individual channels 16A via the vertical channel 53*a*, and with the inlets 16*x* of the second individual channels 16B via the vertical channel 53*b*.

The return channel 52 is disposed directly above the second communication channels 14 of the respective arrays of the individual channels 16A and 16B. The return channel 52 communicates with the outlets 16*y* of all of the individual channels 16A and 16B formed in the head 1. The outlets 16*y* are arranged in the first direction at respective lower end portions, in the second direction, of the return channel 52.

The supply channel 51 entirely overlaps, in the vertical direction, with all of the pressure chambers 12 of the head 1. In contrast, the return channel 52 partially overlaps, in the vertical direction, with all of the pressure chambers 12 of the head 1. In one example, the return channel 52 overlaps, in the vertical direction, with one end, in the second direction, of the respective pressure chamber 12 of the arrays of the individual channels 16A and 16B. The return channel 52 overlaps, in the vertical direction, with a right end in FIGS. 2 and 3 of the respective pressure chamber 12 of the array of the first individual channels 16A and with a left end in FIGS. 2 and 3 of the respective pressure chamber 12 of the array of the second individual channels 16B.

As depicted in FIG. 3, a damper chamber 80 is located between the supply channel 51 and the return channel 52 in the vertical direction. The damper chamber 80 overlaps, in the vertical direction, with a particular region of the supply channel 51. The particular region does not include portions of the supply channel 51 where the vertical channels 53*a* and 53*b* are connected. The damper chamber 80 also overlaps, in the vertical direction, with an entire region of the return channel 52. Although not depicted in the drawings, the damper chamber 80 communicates with the atmosphere at respective ends thereof in the first direction. The pressure in the damper chamber 80 is the same as the atmospheric pressure.

The damper chamber 80 includes a first damper film 81 that partially defines the supply channel 51 and a second damper film 82 that partially defines the return channel 52. For the damper chamber 80, the plate 50*c* has a recess formed in a lower surface thereof, by, for example, half-etching. A portion of a bottom (e.g., a most recessed portion) of the recess overlapping with the supply channel 51 in the vertical direction serves as the first damper film 81. The plate 50*d* covers the recess from below and is bonded to a lower surface of the plate 50*c*. A portion of the plate 50*d* that covers the recess and overlaps with the return channel 52 in the vertical direction serves as the second damper film 82.

The first damper film 81 is longer in the second direction than the second damper film 82. The first damper film 81 has a Young's modulus that is greater than a Young's modulus of the second damper film 82. For example, the plate 50*c* includes metal (e.g., SUS) whereas the plate 50*d* includes resin (e.g., polyimide).

A thickness of the plate 50*a* that defines an upper surface of the supply channel 51 is substantially the same as a thickness of the damper films 81 and 82. The damper films are thus provided both above and below the supply channel 51.

As depicted in FIG. 2, the return channel 52 is longer than the supply channel 51 in the first direction and protrudes to both sides of the supply channel 51 in the first direction. In other words, the supply channel 51 is shorter in the first direction than the return channel 52.

The upper surface of the supply channel 51 has a supply opening 51*x* (e.g., a first opening as claimed) formed therein. The supply opening 51*x* is located at a central portion of the supply channel 51 in a plane perpendicular to the vertical direction. The supply channel 51 communicates with a sub-tank (not depicted) via the supply opening 51*x*. The sub-tank communicates with a main tank and stores ink from the main tank. The ink in the sub-tank is supplied to the supply channel 51 via the supply opening 51*x* as a circulation pump 7*p* (refer to FIG. 4) is driven under the control of the controller 5. The ink flowing into the supply channel 51 is supplied to the respective individual channels 16A via the vertical channel 53*a* and to the respective individual channels 16B via the vertical channel 53*b*.

The return channel 52 has an upper surface defined by the plate 50*d*. The upper surface of the return channel 52 has a return opening 52*x* (e.g., a second opening as claimed) formed therein. The return opening 52*x* extends through the plates 50*a*-50*d* and is located at a position not overlapping with the supply channel 51. The return channel 52 communicates with the sub-tank (not depicted) via the return opening 52*x*. The ink in the individual channels 16A and 16B flows into the return channel 52 and returns to the sub-tank via the return opening 52*x*.

The ink supplied from the supply channel 51 flows into the pressure chambers 12 of the respective individual channels 16A and 16B, via the first communication channels 13, as depicted in FIG. 3. The ink in the pressure chambers 12 moves in the second direction. A portion of the ink is ejected from the nozzles 11, and the remaining ink flows into the return channel 52, via the second communication channels 14.

The ink is thus circulated between the sub-tank and the head 1, thereby achieving discharge of air in channels of the head 1 and preventing or reducing increases in viscosity of ink. If the ink includes settling ingredient (such as pigment that causes settling), the ingredient may be stirred and may not settle.

In view of maintaining meniscuses in the nozzles 11, a dimension of the return channel 52 in the second direction may preferably be approximately 3 mm. The dimension 52H of the return channel 52 in the vertical direction may preferably be approximately 0.3 mm. A dimension of each of the vertical channels 53*a* and 53*b* in the second direction may preferably be approximately 1.5 mm. A dimension of each of the vertical channels 53*a* and 53*b* in the vertical direction may preferably be approximately 0.205 mm. A circulation flow rate per the individual channel 16A, 16B may preferably be approximately 50 nl/s.

As described above, in the first illustrative embodiment, the supply channel 51, the return channel 52, and the pressure chambers 12 are located at different positions in the vertical direction and at least partially overlaps with one another in the vertical direction (refer to FIG. 3). This configuration may increase volumes of the channels 51 and 52 while preventing or reducing increases in the size of the head 1 in the second direction. In the illustrative embodiment, the supply channel 51 is located higher than the return channel 52. This configuration may prevent the air from entering from the supply channel 51 into the pressure chambers 12, due to buoyancy.

The return channel 52 has a channel area that is smaller than a channel area of the supply channel 51 (refer to FIG. 3). This may increase a flow rate in the return channel 52, allowing the air to be discharged effectively via the return channel 52.

The damper chamber 80 is located between the supply channel 51 and the return channel 52 in the vertical direction (refer to FIG. 3). As compared with a configuration in which a damper chamber is individually provided for the supply channel 51 and the return channel 52, the configuration of the illustrative embodiment may simplify the configuration of the head 1 and decrease the size of the head 1 in the vertical direction.

The supply channel 51 has the supply opening 51*x*, in the upper surface thereof. The return channel 52 has the return opening 52*x* in the upper surface thereof. The return opening 52*x* does not overlap with the supply channel 51 (refer to FIG. 2). In a configuration in which the supply channel 51 and the return channel 52 overlap with each other in the vertical direction, tubes may be attached to the supply opening 51*x* and the return opening 52*x* from above, which may facilitate the attachment of the tubes.

The supply channel 51 is longer in the second direction than the return channel 52 and shorter in the vertical direction than the return channel 52 (refer to FIG. 3). This configuration may reduce a difference in a channel resistance between the supply channel 51 and the return channel 52, and reliably maintain meniscuses.

The first communication channel 13, which brings the supply channel 51 into communication with the pressure chamber 12, is located between the supply channel 51 and the pressure chamber 12 in the vertical direction. The second communication channel 14, which brings the return channel 52 into communication with the pressure chamber 12, is located between the return channel 52 and the pressure chamber 12 in the vertical direction (refer to FIG. 3). In other words, the communication channels 13 and 14 are located above the pressure chambers 12. In this configuration, due to buoyancy, the air may be prevented from entering into the pressure chambers 12 via the first communication channels 13, or the air in the pressure chambers 12 may be effectively discharged via the second communication channels 14.

The nozzle 11 of the individual channel 16A, 16B is located directly below or under the pressure chamber 12 (refer to FIG. 3). In a configuration in which the ink flows in and out above the pressure chamber 12, if the nozzle 11 is located directly below or under the connecting channel 215, flow of circulation of ink may not extend near the nozzle 11, which may lead to difficulty in achieving effects of preventing increase in the viscosity of the ink in the nozzle 11. Such a configuration in which the nozzle 11 is disposed under the pressure chamber 12 may prevent or reduce increase in the viscosity of ink in the nozzle 11.

The supply channel 51 and the return channel 52 communicate with both of the first individual channels 16A and the second individual channels 16B. The supply channel 51 and the return channel 52 are disposed above the pressure chambers 12 of the arrays of the first individual channels 16A and the second individual channels 16B, and at least partially overlap, in the vertical direction, with the pressure chambers 12 of the arrays of the first individual channels 16A and the second individual channels 16B (refer to FIG. 3). As compared with a configuration in which the supply channel 51 and the return channel 52 are provided for the respective arrays of the first individual channels 16A and the second individual channels 16B, the configuration of the illustrative embodiment may facilitate configuration of channels and allow the volumes of the channels 51 and 52 to be increased readily.

The protection substrate 40 is disposed at an upper surface of the actuator substrate 30 (refer to FIG. 3). The protection substrate 40 may protect the actuator 30*x*.

The protection substrate 40 defines the lower surface of the return channel 52 (refer to FIG. 3). As compared with a configuration in which a component that defines the lower surface of the return channel 52 is provided separately from the protection substrate 40, the configuration of the illustrative embodiment may reduce the number of components to be used.

Second Illustrative Embodiment

Figure 5:
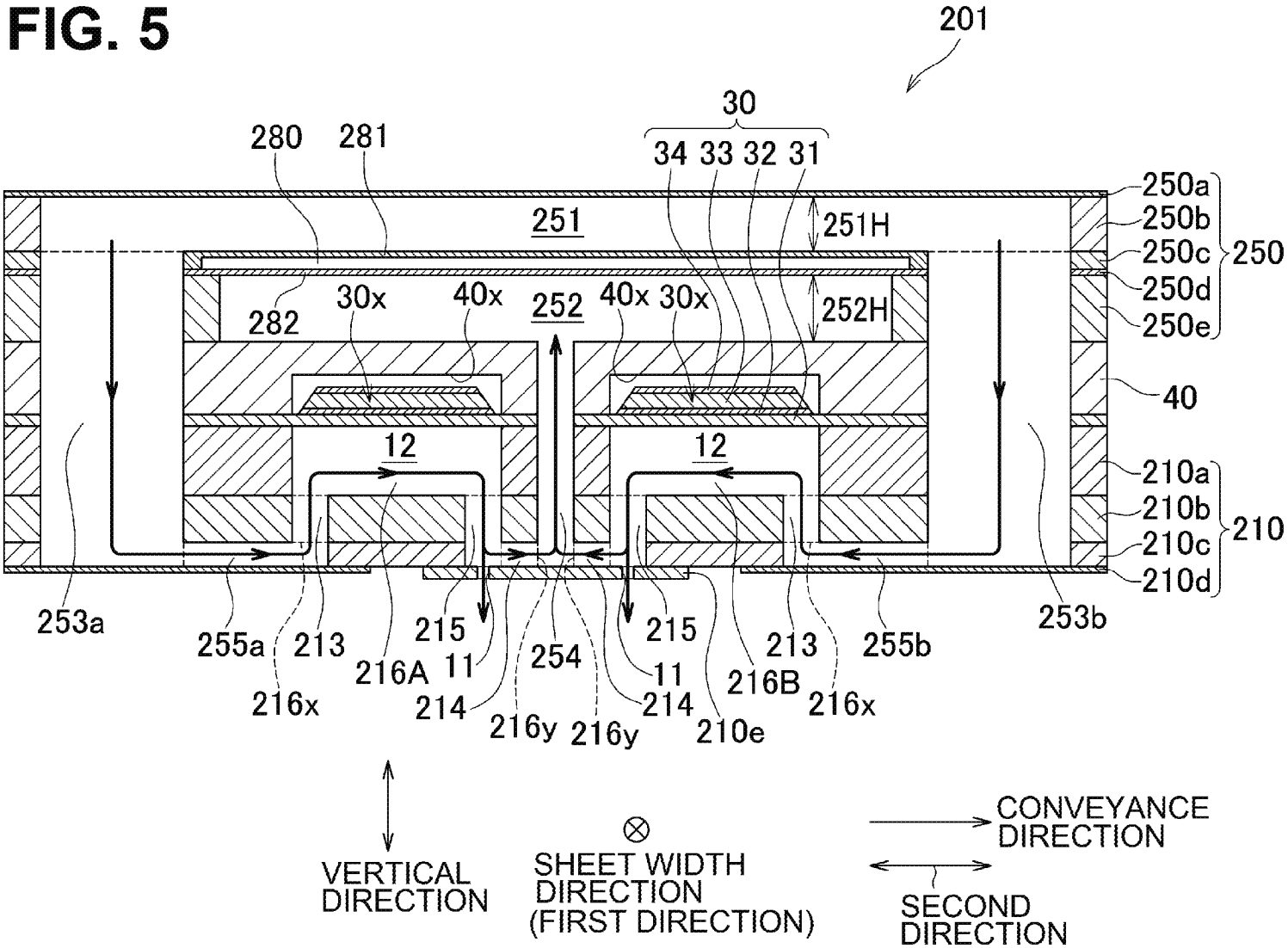
FIG. 5 is a cross-sectional view of a head in a second illustrative embodiment according to aspects of the disclosure.

Referring to FIG. 5, a head 201 according to a second illustrative embodiment of the disclosure will be described below. The components or elements identical to those of the first illustrative embodiment are denoted by the same reference numerals and detailed description of those components/elements described above is omitted with respect to the second illustrative embodiment.

The head 201 includes a channel substrate 210, the actuator substrate 30, the protection substrate 40, and the casing 250.

The channel substrate 210 is disposed below the casing 250. The channel substrate 210 includes three plates 210*a*-210*e* that are laminated in the vertical direction, two plates 210*d* that are bonded to a lower surface of the plate 210*c*, and one plate 210*e*. The plate 210*a* (e.g., a pressure chamber substrate as claimed) has pressure chambers 12 formed therein. The plate 210*b* is bonded to a lower surface of the plate 210*a*. The plate 210*c* is bonded to a lower surface of the plate 210*b*. The two plates 210*d* are spaced from each other in the second direction. The plate 210*d* is thinner than other plates 210*a*-210*c* and 210*e*. The plate 210*d* serves as a damper film. The plate 210*e* is located between the two plates 210*d* in the second direction at a central portion of the lower surface of the plate 210*c* in the second direction. The plate 210*e* (e.g., a nozzle plate as claimed) has nozzles 11 formed therein.

The channel substrate 210 has first individual channels 216A and second individual channels 216B formed therein. The first individual channels 216A are equi-distantly arranged in a row along the first direction, similar to the first individual channels 16A of the first illustrative embodiment. The second individual channels 216B are arranged adjacent to the first individual channels 216A in the second direction and are equi-distantly arranged in a row along the first direction, similar to the second individual channels 16B of the first illustrative embodiment.

The pressure chamber 12 of the first individual channel 216A is an example of a first pressure chamber as claimed. The pressure chamber 12 of the second individual channel 216B is an example of a second pressure chamber as claimed.

The nozzle 11 of the first individual channel 216A is an example of a first nozzle as claimed. The nozzle 11 of the second individual channel 216B is an example of a second nozzle as claimed.

The individual channels 216A and 216B have configurations different from those of the individual channels 16A and 16B of the first illustrative embodiment, respectively. Each of the individual channels 216A and 216B has one nozzle 11, one pressure chamber 12, one introducing channel 213, one connecting channel 215, and one discharge channel 214.

The introducing channel 213 extends downward from one end of the pressure chamber 12 in the second direction. A lower end of the introducing channel 213 correspond to an inlet 216*x* of the individual channel 216A, 216B.

The connecting channel 215 extends downward from the other end of the pressure chamber 12 in the second direction. The connecting channel 215 connects the nozzle 11 and the pressure chamber 12 to each other. In other words, the connecting channel 215 brings the nozzle 11 and the pressure chamber 12 into communication with each other.

The discharge channel 214 extends in the second direction from a lower end portion of a side surface of the connecting channel 215. An end of the discharge channel 214 corresponds to an outlet 216*y* of the individual channel 216A and 216B.

The plate 210*e* defines portions of the discharge channels 214. Each of the discharge channels 214 is located at a position in contact with the nozzles 11 in the vertical direction. A distance in the vertical direction between the nozzle 11 and the discharge channel 214 (which is substantially zero in the second illustrative embodiment) is shorter than a distance in the vertical direction between the actuator substrate 30 and the discharge channel 214.

The discharge channel 214 of the first individual channel 216A is an example of a first discharge channel as claimed. The discharge channel 214 of the second individual channel 216B is an example of a second discharge channel as claimed. The connecting channel 215 of the first individual channel 216A is an example of a first connecting channel as claimed. The connecting channel 215 of the second individual channel 216B is an example of a second connecting channel as claimed.

Arrays of the introducing channels 213 of the individual channels 216A and 216B are located opposite to each other in the second direction with respect to arrays of the discharge channels 214 of the individual channels 216A and 216B. In other words, the array of the discharge channels 214 of the first individual channels 216A and the array of the discharge channels 214 of the second individual channels 216B are located between the array of the introducing channels 213 of the first individual channels 216A and the array of the introducing channels 213 of the second individual channels 216B, in the second direction.

An intermediate channel 254 is disposed between the pressure chambers 12 (e.g., an array of the pressure chambers 12) of the first individual channels 216A and the pressure chambers 12 (e.g., an array of the pressure chambers 12) of the second individual channels 216B, in the second direction. The intermediate channel 254 extends downward from a central portion of a return channel 252 (e.g., a second common channel as claimed) in the second direction. The intermediate channel 254 communicates with the discharge channels 214 of the individual channels 216A and 216B. In other words, the discharge channel 214 of the first individual channel 216A (e.g., the first discharge channel) brings the connecting channel 215 of the first individual channel 216A (e.g., the first connecting channel) and the intermediate channel 254 into communication with each other. The discharge channel 214 of the second individual channel 216B (e.g., the second discharge channel) brings the connecting channel 215 of the second individual channel 216B (e.g., the second connecting channel) and the intermediate channel 254 into communication with each other.

The intermediate channel 254 is defined by through holes formed in the protection substrate 40, the diaphragm 31, and the plates 210*a*-210*c*. The intermediate channel 254 has a dimension in the vertical direction that is greater than or equal to a dimension, in the vertical direction, of a portion of the head 201 that includes the protection substrate 40, the actuator substrate 30, and the plate 210*a*.

Lower ends of the intermediate channel 254 and the discharge channels 214 are defined by a portion of the plate 210*e* between the nozzles 11 of the first individual channels 216A and the nozzles 11 of the second individual channels 216B, in the second direction. In other words, each of the intermediate channel 254 and the discharge channels 214 is at least partially defined by a portion of the plate 210*e* between the nozzles 11 of the first individual channels 216A and the nozzles 11 of the second individual channels 216B, in the second direction.

Similar to the return channel 252, the intermediate channel 254 extends in the first direction. The intermediate channel 254 have the same length in the first direction as the return channel 252.

The intermediate channel 254 brings the return channel 252 into communication with the outlets 216*y* of the individual channels 216A and 216B. The outlets 216*y* of the first individual channels 216A are arranged in the first direction at lower end portions of one side surface, in the second direction, of the intermediate channel 254. The outlets 216*y* of the second individual channels 216B are arranged in the first direction at lower end portions of the other side surface, in the second direction, of the intermediate channel 254.

The casing 250 is bonded on the upper surface of the protection substrate 40. The casing 250 includes five plates 250*a*-250*e* that are laminated in the vertical direction. The casing 250 has through holes formed in the plates 250*b*-250*e*. The through holes define a supply channel 251 (e.g., a first common channel as claimed), the return channel 252, and portions of vertical channels 253*a* and 253*b*. The vertical channels 253*a* and 253*b* are defined by through holes formed in the plates 250*c*, 250*d*, 250*e*, the protection substrate 40, the diaphragm 31, and the plates 210*a*-210*c*.

The supply channel 251 and the return channel 252 are disposed above the individual channels 216A and 216B, and overlap, in the vertical direction, with all of the pressure chambers 12 of the head 1. The return channel 252 and the vertical channels 253*a* and 253*b* are located below the supply channel 251 and overlap, in the vertical direction, with the supply channel 251.

The supply channel 251 has a dimension 251H in the vertical direction that is shorter than a dimension 252H of the return channel 252 in the vertical direction. The return channel 252 has a channel area that is perpendicular to the first direction. The channel area of the return channel 252 is smaller than that of the supply channel 251.

Each of the supply channel 251 and the return channel 252 extends in the first direction. Each of the vertical channels 253*a* and 253*b* is located at a respective end of the supply channel 251 in the second direction, and extends in the first direction.

Horizontal channels 255*a* and 255*b* are connected to lower ends of the vertical channels 253*a* and 253*b*, respectively. The horizontal channel 255*a* extends in the second direction from of a lower end portion of the vertical channel 253*a*. The horizontal channel 255*b* extends in the second direction from of a lower end portion of the vertical channel 253*b*. The horizontal channels 255*a* and 255*b* are located between the vertical channels 253*a* and 253*b* in the second direction. Each of the horizontal channels 255*a* and 255*b* extends in the first direction.

The vertical channels 253*a* and 253*b*, and the horizontal channels 255*a* and 255*b* have the same length, in the first direction, as the supply channel 251.

The supply channel 251 communicates with all inlets 216*x* of the individual channels 216A and 216B formed in the head 201, via the vertical channels 253*a* and 253*b* and the horizontal channels 255*a* and 255*b*. The vertical channel 253*a* and the horizontal channel 255*a* bring one end of the supply channel 251 in the second direction into communication with the inlets 216*x* of the first individual channels 216A. The vertical channel 253*b* and the horizontal channel 255*b* bring the other end of the supply channel 251 in the second direction into communication with the inlets 216*x* of the second individual channels 216B. The inlets 216*x* are arranged in the first direction at upper surfaces of the horizontal channels 255*a* and 255*b*. The supply channel 251 communicates with the inlets 216*x* of the first individual channels 216A via the vertical channel 253*a* and the horizontal channel 255*a*, and with the inlets 216*x* of the second individual channels 216B via the vertical channel 253*b* and the horizontal channel 255*b*.

The return channel 252 is disposed directly above the intermediate channels 254. The return channel 252 communicates with all outlets 216*y* of the individual channels 216A and 216B formed in the head 201. The return channel 252 has a lower surface defined by the protection substrate 40. The upper surface of the protection substrate 40 serves as the lower surface of the return channel 252.

The supply channel 251 and the return channel 252 overlap, in the vertical direction, with all of the pressure chambers 12 of the head 201. The return channel 252 is longer, in the second direction, than the return channel 52 (refer to FIG. 3) of the first illustrative embodiment. The supply channel 251 is longer in the second direction than the return channel 252 and protrudes to both sides of the return channel 252 in the second direction.

Ink is supplied to the supply channel 251 via the supply opening 51*x* (refer to FIG. 2) as the circulation pump 7*p* (refer to FIG. 4) is driven. The ink is then supplied to the individual channels 216A via the vertical channel 253*a* and the horizontal channel 255*a*, and the individual channels 216B via the vertical channel 253*b* and the horizontal channel 255*b*. The ink supplied to the respective individual channels 216A and 216B flows, via the introducing channels 213, into the pressure chambers 12. The ink in the pressure chambers 12 moves in the second direction. The ink then moves down into the connecting channels 215. A portion of the ink is ejected from the nozzles 11, and the remaining ink flows into the intermediate channel 254 through the discharge channels 214. The ink moves up through the intermediate channel 254 to the return channel 252, and is returned to the sub-tank via the return opening 52*x* (refer to FIG. 2).

A damper chamber 280 is located between the supply channel 251 and the return channel 252 in the vertical direction. The damper chamber 280 overlaps, in the vertical direction, with a particular region of the supply channel 251. The particular region does not include portions of the supply channel 251 where the vertical channels 253*a* and 253*b* are connected. The damper chamber 280 also overlaps, in the vertical direction, with an entire region of the return channel 252. Although not depicted in FIG. 5, the damper chamber 280 communicates with the atmosphere at respective ends thereof in the first direction. The pressure in the damper chamber 280 is the same as the atmospheric pressure.

The damper chamber 280 includes a first damper film 281 that partially defines the supply channel 251 and a second damper film 282 that partially defines the return channel 252. For the damper chamber 280, the plate 250*c* has a recess formed in a lower surface thereof, by, for example, half-etching. A portion of a bottom (e.g., a most recessed portion) of the recess overlapping with the supply channel 251 in the vertical direction serves as the first damper film 281. The plate 250*d* covers the recess from below and is bonded to a lower surface of the plate 250*c*. A portion of the plate 250*d* that covers the recess and overlaps with the return channel 252 in the vertical direction serves as the second damper film 282.

The first damper film 281 is longer in the second direction than the second damper film 282. The first damper film 281 has a Young's modulus that is greater than a Young's modulus of the second damper film 282. For example, the plate 250*c* includes metal (e.g., SUS) whereas the plate 250*d* includes resin (e.g., polyimide).

A thickness of the plate 250*a* that defines an upper surface of the supply channel 251 is substantially the same as a thickness of the damper films 281 and 282. The damper films are thus provided both above and below the supply channel 251.

In the second illustrative embodiment as described above, the following effects may be obtained in addition to the effects that may be obtained by the configuration similar to that of the first illustrative embodiment.

The vertical channel 253*a*, 253*b* is an example of a first channel portion as claimed. The vertical channel 253*a*, 253*b* extends in the vertical direction from a portion of the supply channel 251 that does not overlap, in the vertical direction, with the pressure chambers 12, to a position below the pressure chambers 12. The horizontal channel 255*a*, 255*b* and the introducing channel 213 are an example of a second channel portion as claimed. The second channel portion is located below the pressure chambers 12. The second channel portion has one end communicating with the vertical channel 253*a*, 253*b* and the other end communicating with the pressure chamber 12 and overlapping, in the vertical direction, with the pressure chamber 12. In the second illustrative embodiment, each of the vertical channels 253*a* and 253*b* is located to a side of an array of the pressure chambers 12 and extends in the vertical direction. As compared with the configuration of the first illustrative embodiment, the supply channel 251 may be widen in the second direction, which may increase the volume of the supply channel 251.

The vertical channels 253*a* and 253*b* are defined by openings formed in the casing 250 and the channel substrate 210 (e.g., through holes in the plates 250*c*, 250*d*, 250*e*, the protection substrate 40, the diaphragm 31, and the plates 210*a*-210*c*.) The horizontal channels 255*a* and 255*b* are defined by openings formed in lower end portions of the channel substrate 210 (e.g., through holes in the plate-210*c*). This configuration may achieve such an arrangement of the vertical channel 253*a*, 253*b* that is located to a side of an array of the pressure chambers 12 and extends in the vertical direction.

The intermediate channel 254 is disposed between the array of the pressure chambers 12 of the first individual channels 216A and the array of the pressure chambers 12 of the second individual channels 216B, in the second direction. This configuration may reduce the size of the head 201 in the second direction, as compared with a configuration in which the return channel 252 is located, instead of the intermediate channel 254, between the array of the pressure chambers 12 of the first individual channel 216A and the array of the pressure chambers 12 of the second individual channel 216B in the second direction. Further, in the second illustrative embodiment, the connecting channels 215 communicate with the intermediate channel 254 via the discharge channels 214. As compared with a configuration of a third illustrative embodiment (in which the pressure chambers 12 communicate with an intermediate channel 354 via discharge channels 314), as will be described below, the intermediate channel 254 is longer in the vertical direction and ink near the nozzles 11, which are located below the pressure chambers 12, may be corrected readily. Accordingly, increases in the viscosity of ink near the nozzles 11 may be prevented or reduced.

In the second illustrative embodiment, the discharge channel 214 constitute a portion of the individual channel 216A, 216B. In this configuration, if the intermediate channel 254 should be omitted and the discharge channel 214 should extend to the return channel 252, the discharge channel 214 may become longer, which may lead to an increase in the resistance of the discharge channel 214. This may cause difficulty in increasing a circulation flow rate. In contrast, the configuration of the second illustrative embodiment includes the intermediate channel 254 and the discharge channel 214 that does not extend to the return channel 252. This configuration may reduce the resistance of the discharge channel 214 and increase the circulation flow rate.

The intermediate channel 254 has a dimension in the vertical direction that is greater than or equal to a dimension, in the vertical direction, of a portion of the head 201 that includes the protection substrate 40, the actuator substrate 30, and the plate 210*a*. This configuration, in which the intermediate channel 254 extends long in the vertical direction, may allow ink near the nozzles 11 to be collected readily.

A distance in the vertical direction between the nozzle 11 and the discharge channel 214 is shorter than a distance in the vertical direction between the actuator substrate 30 and the discharge channel 214. This configuration, in which the discharge channel 214 is located closer to the nozzle 11 in the vertical direction, may allow ink near the nozzle 11 to be readily collected.

The intermediate channel 254 and the discharge channels 214 are defined by a portion of the plate 210*e* between the nozzles 11 of the first individual channels 216A and the nozzles 11 of the second individual channels 216B, in the second direction. Such a configuration in which the intermediate channel 254 extends long in the vertical direction and the discharge channels 214 are located closer to the nozzles 11 in the vertical direction, may readily achieved. The nozzles 11 of the first individual channels 216A and the nozzles 11 of the second individual channels 216B are formed in one plate 210*e*. This configuration may facilitate the production of the head 201, as compared with a configuration in which the nozzles 11 of the first individual channels 216A and the nozzles 11 of the second individual channels 216B are formed in two plates, because the number of plate bonding operations is reduced.

Third Illustrative Embodiment

Figure 6:
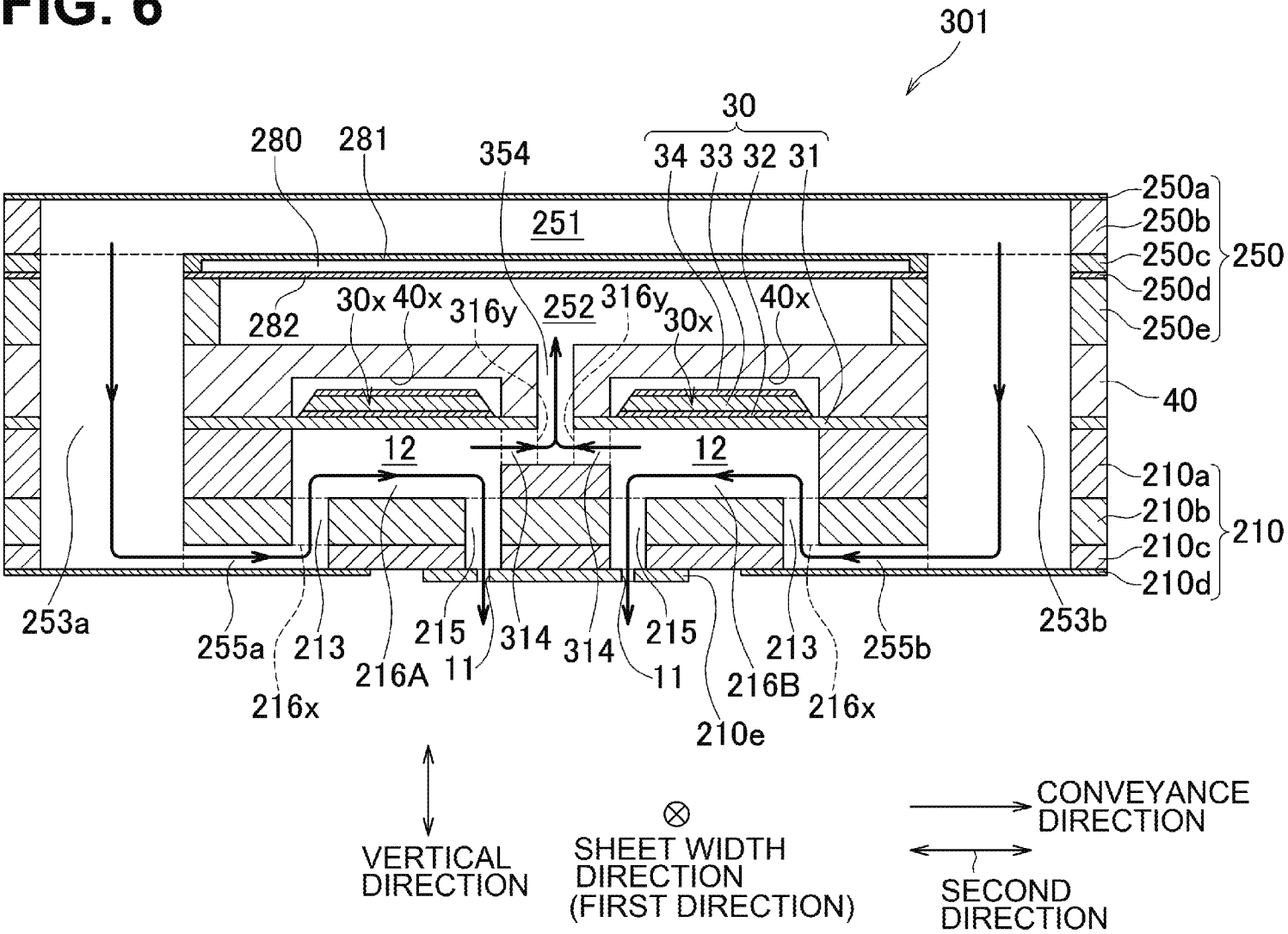
FIG. 6 is a cross-sectional view of a head in a third illustrative embodiment according to aspects of the disclosure.

Referring to FIG. 6, a head 301 according to a third illustrative embodiment of the disclosure will be described below. The third illustrative embodiment is similar to the second illustrative embodiment. The components or elements identical to those of the second embodiment are denoted by the same reference numerals and detailed description of those components/elements is omitted with respect to the third illustrative embodiment.

In the individual channels 216A and 216B, the discharge channels 314 extend in the second direction from upper portions of side surfaces of the pressure chambers 12. Ends of the discharge channels 314 correspond to outlets 316*y* of the individual channels 216A and 216B.

The discharge channel 314 of the first individual channel 216A is an example of a first communication channel as claimed. The discharge channel 314 of the second individual channel 216B is an example of a second communication channel as claimed.

The intermediate channel 354 is disposed between the array of the pressure chambers 12 of the first individual channels 216A and the array of the pressure chambers 12 of the second individual channels 216B, in the second direction. The intermediate channel 354 extends downward from a central portion of the return channel 252 in the second direction. The intermediate channel 354 communicates with the discharge channels 314 of the individual channels 216A and 216B.

The intermediate channel 354 is defined by through holes formed in the protection substrate 40 and the diaphragm 31, and a recess formed in an upper surface of the plate 210*a*, for example, by half-etching. The intermediate channel 354 has a dimension in the vertical direction that is greater than or equal to a dimension, in the vertical direction, of a portion of the head 301 that includes the protection substrate 40 and the actuator substrate 30.

The intermediate channel 354 is shorter, in the vertical direction, than the intermediate channel 254 of the second illustrative embodiment.

The discharge channels 314 are defined by grooves formed in the upper surface of the plate 210*a*, for example, by half-etching. The grooves communicate with a recess that defines a lower end portion of the intermediate channel 354.

Similar to the return channel 252, the intermediate channel 354 extends in the first direction. The intermediate channel 354 has the same length in the first direction as the return channel 252.

The intermediate channel 354 brings the return channel 252 into communication with the outlets 316*y* of the individual channels 216A and 216B. The outlets 316*y* of the first individual channels 216A are arranged in the first direction at one side surface, in the second direction, of the intermediate channel 354. The outlets 316*y* of the second individual channels 216B are arranged in the first direction at the other side surface, in the second direction, of the intermediate channel 354.

As described above, the intermediate channel 354 in the third illustrative embodiment is disposed between the array of the pressure chambers 12 of the first individual channels 216A and the array of the pressure chambers 12 of the second individual channels 216B, in the second direction, similar to the intermediate channel 254 in the second illustrative embodiment. This configuration may reduce the size of the head 301 in the second direction, as compared with a configuration in which the return channel 252 is located, instead of the intermediate channel 354, between the array of the pressure chambers 12 of the first individual channel 216A and the array of the pressure chambers 12 of the second individual channel 216B in the second direction. Similar to the second illustrative embodiment, the configuration of the third illustrative embodiment includes the intermediate channel 354 and the discharge channel 314 that does not extend to the return channel 252. This configuration may reduce the resistance of the discharge channels 314 and increase the circulation flow rate. Further, in the configuration of the third illustrative embodiment in which the discharge channel 314 constitutes a portion of the individual channel 216A, 216B, the intermediate channel 354 is provided, and the discharge channel 314 does not extend to the return channel 252, the resistance of the discharge channel 314 may be reduced similar to the second illustrative embodiment.

A portion of the intermediate channel 354 is defined by the recess formed in the upper surface of the plate 210*a*. The discharge channels 314 are defined by the grooves formed in the upper surface of the plate 210*a* and communicating with the recess. This configuration may allow the air in the upper portion of the pressure chambers 12 to be effectively discharged through the discharge channels 314.

Fourth Illustrative Embodiment

Figure 7:
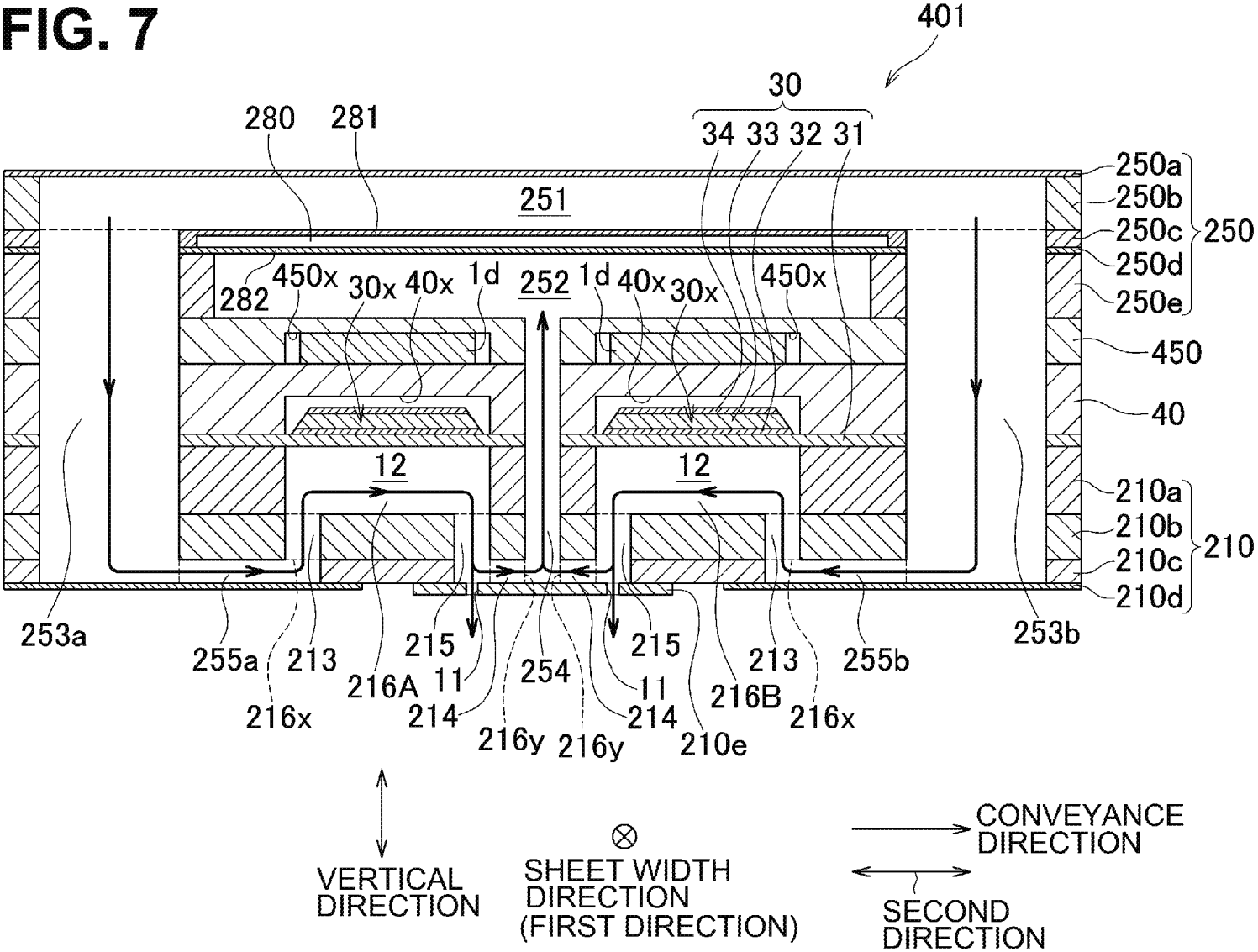
FIG. 7 is a cross-sectional view of a head in a fourth illustrative embodiment according to aspects of the disclosure.

Referring to FIG. 7, a head 401 according to a fourth illustrative embodiment of the disclosure will be described below. The fourth illustrative embodiment is similar to the second illustrative embodiment. The components or elements identical to those of the second embodiment are denoted by the same reference numerals and detailed description of those components/elements is omitted with respect to the fourth illustrative embodiment.

The head 401 includes the channel substrate 210, the actuator substrate 30, the protection substrate 40, the casing 250, and an IC accommodating member 450.

The IC accommodating member 450 is bonded to the upper surface of the protection substrate 40 and a lower surface of the casing 250. The IC accommodating member 450 has through holes that constitute a portion of each of the vertical channels 253*a* and 253*b* and the intermediate channel 254, and two recesses 450*x* in which the driver ICs 1*d* (e.g., a drive circuit as claimed) are located. Each of the two recesses 450*x* overlaps, in the vertical direction, with a corresponding one of the recesses 40*x* of the protection substrate 40, and extend in the first direction.

Each of the driver ICs 1*d* electrically connects to a corresponding common electrode 32 provided for a respective array of the individual channels 216A and 216B, and the individual electrodes 34 of the corresponding individual channels 216A and 216B, via wirings (not depicted). The driver IC 1*d* is located between a bottom wall (e.g., a most-recessed wall) of the recess 450*x* of the IC accommodating member 450 and the protection substrate 40.

The return channel 252 has a lower surface defined by the IC accommodating member 450. The upper surface of the IC accommodating member 450 serves as the lower surface of the return channel 252. The driver IC 1*d* is located between the return channel 252 and the protection substrate 40 in the vertical direction. The driver IC 1*d* is in contact with a wall that defines the return channel 252 (e.g., the bottom or most-recessed wall of the recess 450*x* of the IC accommodating member 450).

As described above, in the fourth illustrative embodiment, the driver IC 1*d* is in contact with the wall that defines the return channel 252. This configuration may allow the heat from the driver IC 1*d* to be transferred through the wall to the ink in the return channel 252, thereby cooling the driver IC 1*d*.

In the fourth illustrative embodiment, the driver IC 1*d* is in contact with a wall that defines the return channel 252, not a wall that defines the supply channel 251. In a configuration in which the driver IC 1*d* contacts a wall that defines the supply channel 251, the heat from the driver IC 1*d* may raise the temperature of the ink in the supply channel 251. Supply of such ink to the pressure chambers 12 may cause variances in the ejected ink and/or ink satellites. The configuration of the fourth illustrative embodiment may prevent or reduce the variances in the ejected ink and/or ink satellites.

Fifth Illustrative Embodiment

Figure 8:
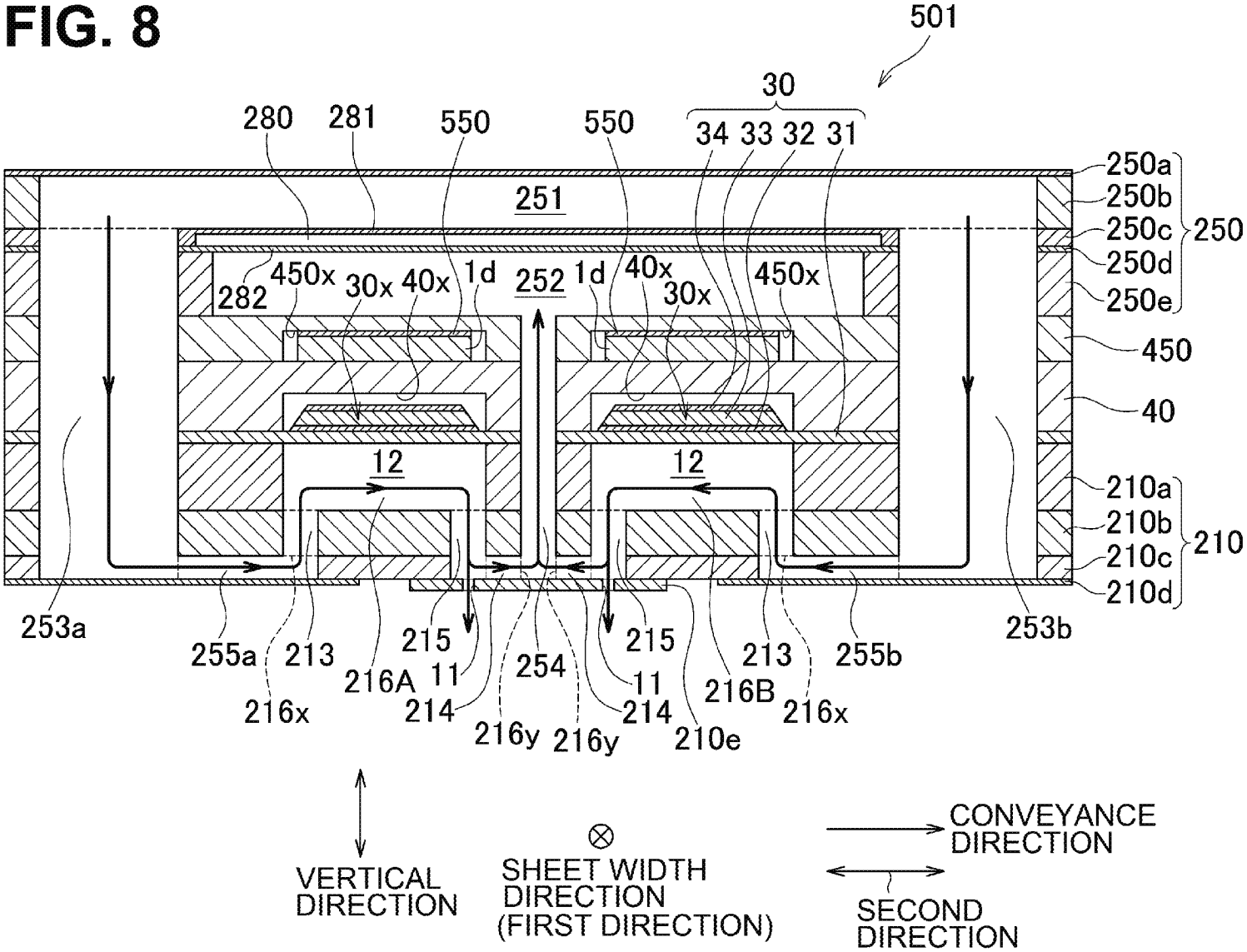
FIG. 8 is a cross-sectional view of a head in a fifth illustrative embodiment according to aspects of the disclosure.

Referring to FIG. 8, a head 501 according to a fifth illustrative embodiment of the disclosure will be described below. The fifth illustrative embodiment is similar to the fourth illustrative embodiment. The components or elements identical to those of the fourth embodiment are denoted by the same reference numerals and detailed description of those components/elements is omitted with respect to the fifth illustrative embodiment.

The driver IC 1*d* and a heat transfer member 550 are disposed in each of the two recesses 450*x* of the IC accommodating member 450. The heat transfer member 550 is located at an upper surface of the driver IC 1*d*. The heat transfer member 550 is in contact with the driver IC 1*d* and a wall that defines the return channel 252 (e.g., the bottom or most-recessed wall of the recess 450*x* of the IC accommodating member 450). The heat transfer member 550 has an elasticity and a thermal conductivity. Examples of the heat transfer member 550 may include a sheet and grease.

As described above, in the fifth illustrative embodiment, the heat transfer member 550 is in contact with the driver IC 1*d* and the wall defining the return channel 252. This configuration may allow the heat from the driver IC 1*d* to be transferred, through the heat transfer member 550 and the wall, to the ink in the return channel 252, thereby cooling the driver IC 1*d*.

Modifications

While aspects of the disclosure have been described in detail with reference to the specific embodiments thereof, various changes, arrangements and modifications may be applied therein as will be described below.

For example, in the illustrative embodiments, the supply channel is an example of a first common channel, and the return channel is an example of a second common channel. Alternatively, the return channel may be an example of a first common channel, and the supply channel may be an example of a second common channel. The first common channel may communicate with one of the inlet and the outlet of the respective individual channel, and the second common channel may communicate with the other one of the inlet and outlet of the respective individual channel.

In the above-described illustrative embodiments, the supply channel overlaps with an entire of each pressure chamber in the vertical direction. Alternatively, the supply channel may overlap with a portion of each pressure chamber in the vertical direction. In other words, the first common channel and the second common channel may not necessarily overlap with an entire of each pressure chamber in the vertical direction, but may overlap with a portion of each pressure chamber in the vertical direction.

In the illustrative embodiments, each of the first damper film and the second damper film includes different material, thereby achieving a greater Young's modulus of the first damper film than a Young's modulus of the second damper film. Alternatively, each of the first damper film and the second damper film may have a different thickness to achieve a greater Young's modulus of the first damper film than a Young's modulus of the second damper film. For example, the first damper film may be thicker than the second damper film.

The first damper film and the second damper film may have the same Young's modulus. For example, the first damper film and the second damper film may both include resin (e.g., polyimide).

The damper chamber may not necessarily be provided between the first common channel and the second common channel. For example, the damper chamber may be provided individually for the first and the second common channels. Further, the damper chamber may be provided at a side surface of the common channel, instead of providing at an upper or lower surface of the common channel. The damper chamber and/or the damper films may not necessarily be provided for the common channel.

The casing may not necessarily include a plurality of plates. For example, the casing may be integrally formed of resin by molding.

In the first illustrative embodiment, the vertical channels 53*a* and 53*b* extend in the first direction and communicate with the individual channels 16A and 16B. In some embodiments, each of the vertical channels 53*a* and 53*b* may be provided for a corresponding one of the communication channel 13, constituting the individual channel 16A, 16B. In this configuration, upper ends of the vertical channels 53*a* and 53*b* correspond to the inlets 16*x* of the individual channels 16A and 16B, respectively.

In the first illustrative embodiment, the communication channels 13 and 14 constitute the individual channels 16A and 16B. In some embodiments, the communication channels 13 and 14 may extend in the first direction, similar to the vertical channels 53*a* and 53*b*. In this configuration, upper end portions of the pressure chamber 12 connected to or communicating with the communication channels 13 and 14 correspond to the inlet 16*x* and the outlet 16*y*, respectively, of the individual channel 16A, 16B.

In the second Illustrative embodiment, the vertical channel 253*a*, 253*b* and the horizontal channel 255*a*, 255*b* extend in the first direction and communicate with the individual channel 216A, 216A, respectively. In some embodiments, the vertical channel 253*a*, 253*b* and the horizontal channel 255*a*, 255*b* may be provided for a corresponding one of the introducing channels 213, constituting the individual channel 216A, 216B. In this configuration, an upper end of the vertical channel 253*a*, 253*b* corresponds to the inlet 216*x* of the individual channel 216A, 216B, respectively.

In the second illustrative embodiment, the introducing channel 213 constitutes a portion of the individual channel 216A, 216B. In some embodiments, the introducing channel 213 may extend in the first direction similar to the vertical channel 253*a*, 253*b* and the horizontal channels 255*a*, 255*b*. In this configuration, a lower end portion of the pressure chamber 12 connected to or communicating with the introducing channel 213 corresponds to the inlet 216*x* of the individual channel 216A, 216B.

In the second and third illustrative embodiments, the discharge channels 214 and 314 constitute portions of the individual channels 216A and 216B. The discharge channels 214 and 314 may extend in the first direction, similar to the intermediate channel 254, 354. In this configuration, in the second illustrative embodiment, a portion of a side surface of the connecting channel 215 connected to or communicating with the discharge channel 214 corresponds to the outlet 216*y* of the individual channel 216A, 216B. In the third illustrative embodiment, a portion of a side surface of the pressure chamber 12 connected to or communicating with the discharge channel 314 corresponds to the outlet 316*y* of the individual channel 216A, 216B.

In the fourth and fifth illustrative embodiments, a wall that defines a second common channel (e.g., the bottom or most-recessed wall of the recess 450*x* of the IC accommodating member 450) may preferably include material having a high thermal conductivity (e.g., metal such as SUS), from the perspective of enhancing the cooling effect of the driver ICs 1*d*.

The first common channel and the second common channel may be provided for each array of the first individual channels and the second individual channels. In other words, in the illustrative embodiments, the first common channel and the second common channel communicate with both arrays of the first individual channels and the second individual channels. In some embodiments, the first common channel and the second common channel may communicate with the array of the first individual channels but not communicate with the array of the second individual channels. Other common channels that communicate with the array of the second individual channels may be provided. In this configuration, different types (e.g., colors) of liquid may be supplied to the respective arrays of the first individual channels and the second individual channels.

The liquid ejection head may not necessarily include second individual channels, but may include the first individual channels and the first and second common channels that communicate with the first individual channels.

In the above-described illustrative embodiments (in FIG. 1), the head unit 1*x* includes four heads 1. However, the number of heads 1 in the head unit 1*x* is not limited to a particular number. For example, a head unit 1*x* may include six or eight heads 1. An apparatus to which aspects of the disclosure are applied may be such an apparatus that includes one head, other than an apparatus that includes a head unit including a plurality of heads.

Aspects of the disclosure may be applied to, for example, facsimile machines, copiers, and multi-functional devices other than printers. Aspects of the disclosure may be applied to a liquid ejection apparatus used for a purpose other than image recording. For example, aspects of the disclosure may be applied to a liquid ejection apparatus that forms a conductive pattern by ejecting conductive liquid on a substrate.

What is claimed is:

1. A liquid ejection head, comprising:

a plurality of first individual channels arranged in a first direction perpendicular to a vertical direction;

a first common channel extending in the first direction, the first common channel communicating with the first individual channels; and a second common channel located below the first common channel and extending in the first direction, the second common channel communicating with the first individual channels, wherein each of the first individual channels includes one of first nozzles, and one of first pressure chambers that communicate with the respective first nozzles and are located above the first nozzles, the first common channel and the second common channel overlap, in the vertical direction, with each other at a position above the first pressure chambers, and each of the first common channel and the second common channel at least partially overlaps, in the vertical direction, with the first pressure chambers.

2. The liquid ejection head according to claim 1, wherein the first common channel communicates with inlets of the first individual channels, the second common channel communicates with outlets of the first individual channels, and the second common channel has a channel area that is smaller than a channel area of the first common channel.

3. The liquid ejection head according to claim 1, further comprising a damper chamber located between the first common channel and the second common channel in the vertical direction, the damper chamber including a first damper film that partially defines the first common channel and a second damper film that partially defines the second common channel.

4. The liquid ejection head according to claim 1, wherein the first common channel is shorter in the first direction than the second common channel, and is longer in a second direction that is perpendicular to both of the first direction and the vertical direction, than the second common channel, the first common channel has an upper surface having a first opening formed therein, the second common channel has an upper surface having a second opening formed therein at a position not overlapping with the first common channel.

5. The liquid ejection head according to claim 1, wherein one of the first common channel and the second common channel is longer, in a second direction that is perpendicular to both of the first direction and the vertical direction, than the other one of the first common channel and the second common channel, and is shorter in the vertical direction than the other one of the first common channel and the second common channel.

6. The liquid ejection head according to claim 1, further comprising a first communication channel located between the first common channel and the first pressure chambers in the vertical direction, a first communication channel bringing the first common channel and the one of the first pressure chambers into communication with each other; and a second communication channel located between the second common channel and the first pressure chambers in the vertical direction, the second communication channel bringing the second common channel and the one of the first pressure chambers into communication with each other.

7. The liquid ejection head according to claim 6, wherein the one of the first nozzles of each of the first individual channels is located directly below the one of the first pressure chambers.

8. The liquid ejection head according to claim 1, further comprising:

a first channel portion extending in the first direction from a portion of the first common channel that does not overlap, in the vertical direction, with the first pressure chambers to a position below the first pressure chambers; and a second channel portion located below the first pressure chambers, the second channel portion having one end communicating with the first channel portion and the other end communicating with the one of the first pressure chambers and overlapping with the one of the first pressure chambers in the vertical direction.

9. The liquid ejection head according to claim 8, further comprising:

a casing having the first common channel and the second common channel formed therein; and a channel substrate disposed below the casing, the channel substrate having the first individual channels formed therein, wherein the first channel portion is defined by openings formed in the casing and the channel substrate, and the second channel portion is defined by an opening formed in a lower end portion of the channel substrate.

10. The liquid ejection head according to claim 1, further comprising a plurality of second individual channels arranged in the first direction, adjacent to the first individual channels in a second direction that is perpendicular to both of the first direction and the vertical direction, wherein each of the first common channel and the second common channel communicate with the second individual channels, each of the second individual channels includes one of second nozzles, and one of second pressure chambers that communicate with the respective second nozzles and are located above the second nozzles, each of the first common channel and the second common channel is located above the second pressure chambers, and at least partially overlaps, in the vertical direction, with the second pressure chambers.

11. The liquid ejection head according to claim 10, wherein the first common channel communicates with inlets of the first individual channels, the second common channel communicates with outlets of the first individual channels, each of the first individual channels includes a first connecting channel that brings the one of the first nozzles and the one of the first pressure chambers into communication with each other, each of the second individual channels includes a second connecting channel that brings the one of the second nozzles and the one of the second pressure chambers into communication with each other, wherein the liquid ejection head further comprises:

an intermediate channel that is disposed between the first pressure chambers and the second pressure chambers in the second direction, the intermediate channel extending downward from the second common channel;

a first discharge channel that brings the first connecting channel and the intermediate channel into communication with each other; and a second discharge channel that brings the second connecting channel and the intermediate channel into communication with each other.

12. The liquid ejection head according to claim 11, further comprising a pressure chamber substrate having the first pressure chambers and the second pressure chambers formed therein;

an actuator substrate disposed at an upper surface of the pressure chamber substrate, the actuator substrate including a plurality of actuators that overlap, in the vertical direction, with the respective first pressure chambers and the second pressure chambers; and a protection substrate disposed at an upper surface of the actuator substrate, the protection substrate including a recess in which the actuators are located, wherein the intermediate channel has a dimension, in the vertical direction, that is greater than or equal to a dimension, in the vertical direction, of a portion of the liquid ejection head that includes the protection substrate, the actuator substrate, and the pressure chamber substrate.

13. The liquid ejection head according to claim 12, wherein a distance in the vertical direction between the one of the first nozzles and the first discharge channel is shorter than a distance in the vertical direction between the actuator substrate and the first discharge channel, and a distance in the vertical direction between the one of the second nozzles and the second discharge channel is shorter than a distance in the vertical direction between the actuator substrate and the second discharge channel.

14. The liquid ejection head according to claim 13, further comprising a nozzle plate having the first nozzles in correspondence with the respective first individual channels, and the second nozzles in correspondence with the respective second individual channels, wherein an end of each of the intermediate channel, the first discharge channel, and the second discharge channel is defined by a portion of the nozzle plate between the first nozzles and the second nozzles in the second direction.

15. The liquid ejection head according to claim 10, further comprising:

an intermediate channel disposed between the first pressure chambers and the second pressure chambers in the second direction, the intermediate channel extending downward from the second common channel;

a first communication channel that brings the intermediate channel and the one of the first pressure chambers into communication with each other; and a second communication channel that brings the intermediate channel and the one of the second pressure chambers into communication with each other.

16. The liquid ejection head according to claim 15, wherein the first common channel communicates with inlets of the first individual channels, the second common channel communicates with outlets of the first individual channels, wherein the liquid ejection head further comprises:

a pressure chamber substrate having the first pressure chambers and the second pressure chambers formed therein;

an actuator substrate disposed at an upper surface of the pressure chamber substrate, the actuator substrate including a plurality of actuators that overlap, in the vertical direction, with the respective first pressure chambers and the second pressure chambers; and a protection substrate disposed at an upper surface of the actuator substrate, the protection substrate including a recess in which the actuators are located, wherein the intermediate channel has a dimension, in the vertical direction, that is greater than or equal to a dimension, in the vertical direction, of a portion of the liquid ejection head that includes the protection substrate and the actuator substrate, and the intermediate channel includes a recess formed in the upper surface of the pressure chamber substrate; and each of the first communication channel and the second communication channel is defined by a groove that is formed in the upper surface of the pressure chamber substrate and communicates with the recess.

17. The liquid ejection head according to claim 1, further comprising:

a pressure chamber substrate having the first pressure chambers formed therein;

an actuator substrate disposed at an upper surface of the pressure chamber substrate, the actuator substrate including a plurality of actuators that overlap, in the vertical direction, with the respective first pressure chambers; and a protection substrate disposed at an upper surface of the actuator substrate, the protection substrate including a recess in which the actuators are located.

18. The liquid ejection head according to claim 17, wherein the protection substrate defines a lower surface of the second common channel.

19. The liquid ejection head according to claim 17, further comprising a drive circuit configured to electrically connect to the actuators and apply drive signals to the actuators, the drive circuit being located between the second common channel and the protection substrate, in the vertical direction, wherein the drive circuit is in contact with a wall defining the second common channel.

20. The liquid ejection head according to claim 17, further comprising a drive circuit configured to electrically connect to the actuators and apply drive signals to the actuators, the drive circuit being located between the second common channel and the protection substrate, in the vertical direction; and a heat transfer member that has elasticity and is in contact with a wall defining the second common channel and the drive circuit.

* * * * *